United States Patent [19]

Leonard et al.

[11] 4,254,631

[45] Mar. 10, 1981

[54] METHOD AND APPARATUS FOR SATISFYING HEATING AND COOLING DEMANDS AND CONTROL THEREFOR

[75] Inventors: Gary S. Leonard, Minoa; Raymond L. Eckman, Manlius, both of N.Y.

[73] Assignee: Carrier Corporation, Syracuse, N.Y.

[21] Appl. No.: 78,877

[22] Filed: Sep. 26, 1979

[51] Int. Cl.[3] ..... F25B 1/0

[52] U.S. Cl. ..... 62/117

[58] Field of Search ..... 62/196 A, 175, 510, 62/117, 238 E

[56] References Cited

U.S. PATENT DOCUMENTS

| | | | |
|---|---|---|---|
| 3,301,002 | 1/1967 | McGrath | 62/238 E |
| 3,635,041 | 1/1972 | Endress et al. | 62/117 |
| 3,665,724 | 5/1972 | Anderson et al. | 62/196 |

*Primary Examiner*—William E. Wayner

*Attorney, Agent, or Firm*—J. Raymond Curtin; John S. Sensny

[57] ABSTRACT

Apparatus for satisfying heating and cooling demands including a cooling circuit including a mechanical refrigeration unit having a low pressure side and a high pressure side, a heating circuit including a booster compressor for drawing and further compressing refrigerant from the high pressure side of the refrigeration unit, and a heat reclaiming condenser for passing the further compressed refrigerant vapor in heat transfer relation with a heat transfer fluid to heat the fluid and condense the refrigerant vapor. Also disclosed is a control for stabilizing the vapor flow rate through the booster compressor when the pressure in the high pressure side of the refrigeration unit falls below a first predetermined value and for reducing the vapor flow rate through the booster compressor when the pressure in the high pressure side of the refrigeration unit falls below a second predetermined value less than the first predetermined value.

9 Claims, 1 Drawing Figure

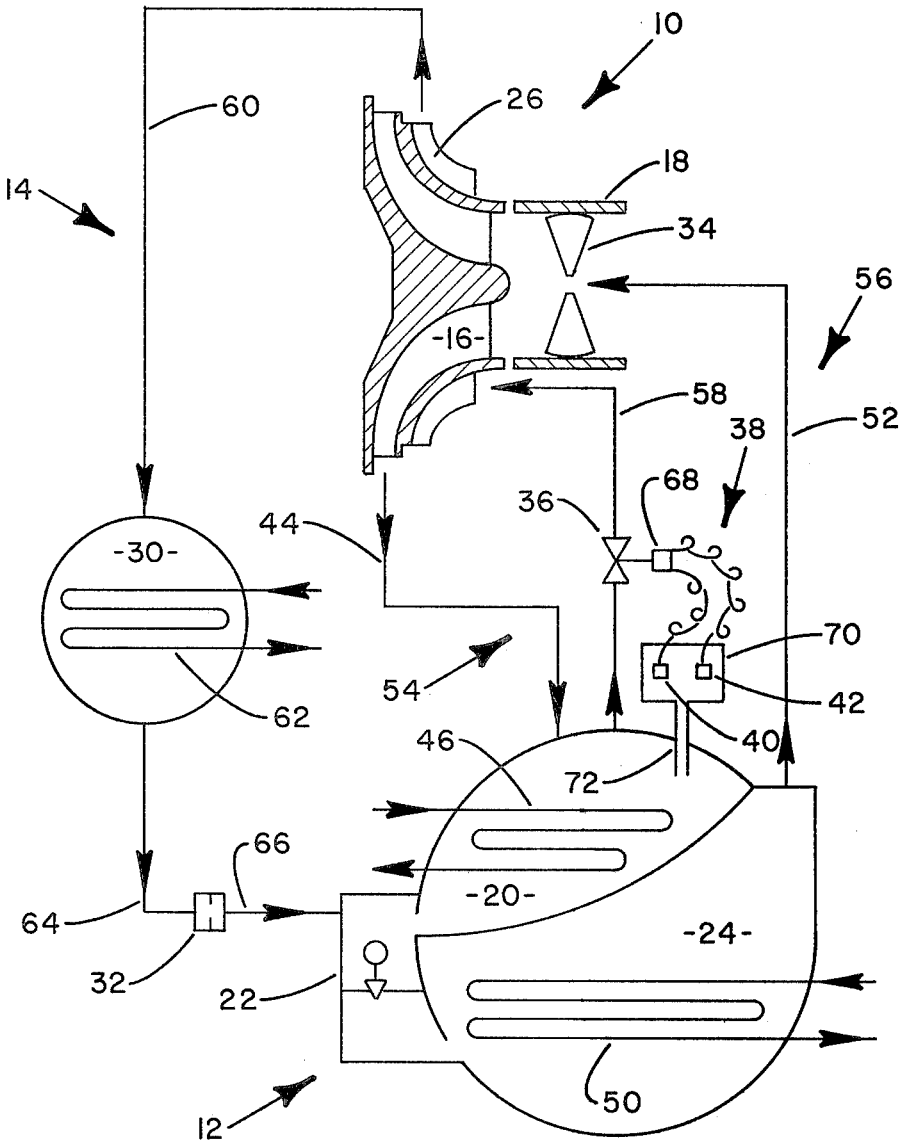
10
60
26
18
14
34
56
-16-
58
52
38
68
36
44
-30-
70
54
42
62
40
46
72
66
-20-
64
-24-
32
22
50
12

METHOD AND APPARATUS FOR SATISFYING HEATING AND COOLING DEMANDS AND CONTROL THEREFOR

BACKGROUND OF THE INVENTION

This invention relates generally to methods and apparatus for simultaneously satisfying heating and cooling demands.

Refrigeration apparatus or machines are frequently employed to cool a fluid such as water which is circulated through various rooms or enclosures of a building to cool these areas. Often, the refrigerant of such machines rejects a relatively large amount of heat at the condenser of the machine. This rejected heat is commonly dissipated to the atmosphere, either directly or via a cooling fluid that circulates between the condenser and a cooling tower. Over a period of time, the rejected heat represents a substantial loss of energy, and much attention has been recently directed to reclaiming or recovering this heat to satisfy a heating load or demand.

One general approach to reclaiming this heat is to employ a booster compressor to draw and further compress refrigerant from the condenser of the refrigeration machine. This further compressed vapor is then passed through a separate, heat reclaiming condenser. A heat transfer fluid is circulated through the heat reclaiming condenser in heat transfer relation with the refrigerant passing therethrough. Heat is transferred from the refrigerant to the heat transfer fluid, heating the fluid and condensing the refrigerant. The heated heat transfer fluid may then be used to satisfy a present heating load or the fluid may be stored for later use, and the condensed refrigerant is returned to the cooling circuit for further use therein.

With refrigeration machines having both a cooling circuit and heating circuit as described above, it is necessary to control the heating and cooling circuits to meet varying heating and cooling loads, and it is preferred to control the heating and cooling circuits independent of each other so that variations in one circuit do not affect the other circuit's ability to handle loads placed thereon. However, difficulties arise when the heating and cooling circuits are independently controlled. For example, if the refrigeration machine is called on to simultaneously handle a low cooling load and a high heating load, then the refrigerant flow rate through the cooling circuit is comparatively small and a relatively small amount of vapor is discharged from the compressor of the cooling circuit. At the same time, the refrigerant flow rate through the heating circuit is relatively large and a relatively large portion of the refrigerant discharged from the compressor of the cooling circuit is drawn into the booster compressor and passed through the heating circuit. In fact, under extreme conditions, the refrigerant flow rate through the booster compressor may temporarily exceed the rate at which refrigerant is discharged from the compressor of the cooling circuit. When this occurs, the mass of refrigerant vapor in the condenser of the cooling circuit decreases, decreasing the pressure therein. This, in turn, decreases the pressure at the inlet of the booster compressor. If this pressure falls to a very low level, the temperature of the vapor discharged from the booster compressor may become undesirably high, or the booster compressor may enter what is known as surge conditions wherein there are periodic complete flow reversals in the compressor, destroying the efficiency of the compressor and endangering the integrity of the elements thereof.

SUMMARY OF THE INVENTION

In light of the above, an object of the present invention is to improve methods and apparatus for satisfying heating and cooling demands.

Another object of this invention is to prevent a booster stage compressor of a booster type refrigeration machine from entering surge conditions or from discharging refrigerant vapor at undesirably high temperatures when a low cooling load and a high heating load are simultaneously placed on the refrigeration machine.

A further object of the present invention is to stabilize the vapor flow rate through a booster stage compressor of a booster type refrigeration machine when the pressure of refrigerant vapor on the high pressure side of the cooling circuit of the machine falls below a first predetermined value, and to reduce the vapor flow rate through the booster stage compressor when the pressure of refrigerant vapor in the high pressure side of the cooling circuit falls below a second predetermined value.

These and other objectives are attained with apparatus for satisfying heating and cooling demands comprising a cooling circuit including a mechanical refrigeration unit having a high pressure side and a low pressure side, a heating circuit including a booster compressor for drawing and further compressing refrigerant from the high pressure side of the refrigeration unit, and a heat reclaiming condenser for passing the further compressed refrigerant vapor in heat transfer relation with a heat transfer fluid to heat the fluid and condense the refrigerant vapor. The apparatus also comprises means for preventing the vapor flow rate through the booster compressor from increasing when the pressure in the high pressure side of the refrigeration unit falls below a first predetermined value, and means for reducing the vapor flow rate through the booster compressor when the pressure in the high pressure side of the refrigeration unit falls below a second predetermined value less than the first predetermined value.

A BRIEF DESCRIPTION OF THE DRAWING

The sole FIGURE is a schematic representation of a vapor compression refrigeration machine incorporating teachings of the present invention.

DETAILED DESCRIPTION OF THE PREFERRED EMBODIMENT

The sole FIGURE is a schematic illustration of refrigeration machine 10 employing teachings of the present invention. Machine 10 includes, generally, cooling circuit 12 and heating circuit 14. Cooling circuit 12, in turn, includes primary compressor means such as first stage 16 of two stage compressor 18, primary condenser 20, primary expansion means 22, and evaporator 24. Heating circuit 14 includes booster compressor means such as second stage 26 of compressor 18, heat reclaiming condenser 30, and auxiliary expansion means 32. Inlet guide vanes 34 are provided to control the vapor flow through first stage 16 of compressor 18 and, thus, through cooling circuit 12, while valve 36 is utilized to regulate the vapor flow through second stage 26 of compressor 18 and, hence, through heating circuit 14. Pressure sensor 38, preferably including two pressure switches 40 and 42, is in vapor communication with primary condenser 20 to control valve 36 in a manner more fully discussed below. Motor or drive means (not shown) is employed in a manner which will be apparent to those skilled in the art to simultaneously drive first and second stages 16 and 26 of compressor 18.

In operation, first stage 16 of compressor 18 discharges hot, compressed refrigerant vapor into primary condenser 20 via line 44. Refrigerant passes through primary condenser 20, rejects heat to an external heat exchange medium such as water circulating through heat exchange coil 46 located therein, and condenses. The condensed refrigerant flows through primary expansion means 22, reducing the temperature and pressure of the refrigerant. The expanded refrigerant enters and passes through evaporator 24 and absorbs heat from an external heat transfer medium such as water passing through heat exchange coil 50 which is positioned within the evaporator. The heat transfer medium is thus cooled and the refrigerant is evaporated. The cooled heat transfer medium may then be used to satisfy a cooling load, and the evaporated refrigerant is drawn from evaporator 24 into line 52 leading back to first stage 16 of compressor 18.

As described above, first stage 16 of compressor 18 and primary expansion means 22 separate cooling circuit 12 into high pressure side 54 and low pressure side 56, and booster inlet line 58 is provided for tansmitting refrigerant vapor from the high pressure side of the cooling circuit to second stage 26 of compressor 18. In the embodiment depicted in the drawing, inlet line 58 is connected to primary condenser 20 and transmits a portion of the refrigerant vapor passing therethrough to second stage 26 of compressor 18. Alternately, line 58 could be connected to discharge line 44. Second stage 26 of compressor 18 further compresses the vapor transmitted thereto, further raising the temperature and pressure of the vapor. This further compressed vapor is discharged into line 60, leading to heat reclaiming condenser 30. The refrigerant vapor enters and passes through heat reclaiming condenser 30 in heat transfer relation with a heat transfer fluid such as water passing through heat exchange coil 62 disposed within the heat reclaiming condenser. Heat is transferred from the refrigerant vapor to the fluid passing through coil 62, heating the fluid and condensing the refrigerant. The heated heat transfer fluid may then be employed to satisfy a heating load. Refrigerant condensed in heat reclaiming condenser 30 passes therefrom back to cooling circuit 12 via return means including auxiliary expansion means such as orifice 32 and refrigerant lines 64 and 66. More particularly, refrigerant condensed in heat reclaiming condenser 30 passes therefrom to orifice 32 via line 64. The condensed refrigerant flows through orifice 32, reducing the pressure and temperature of the refrigerant. Refrigerant line 66 transmits refrigerant from orifice 32 back to cooling circuit 12, specifically primary expansion means 22 thereof, for further use in the cooling circuit.

Guide vanes 34 may be controlled in response to any one or more of a number of factors indicative of changes in the load on cooling circuit 12 to vary the capacity thereof. For example, guide vanes 34 may be controlled in response to the temperature of the fluid leaving heat exchanger 50 of evaporator 24. As the cooling load increases or decreases, guide vanes 34 move between minimum and maximum vapor flow positions to increase or decrease, respectively, the vapor flow rate through first stage 16 of compressor 18 and, thus, cooling circuit 12. Similarly, valve 36 may be controlled in response to any one or more factors indicating changes in the load on heating circuit 14 to vary the capacity thereof. For example, valve 36 may be controlled in response to the temperature of the fluid discharged from heat exchanger 62 of heat reclaiming condenser 30. As the heating load increases or decreases, positioning means 68 moves valve 36 between minimum and maximum vapor flow positions to increase or decrease, respectively, the vapor flow rate through second stage 26 of compressor 18 and, hence, through heating circuit 14. Positioning means 68 may be of any suitable type, for example an electric, hydraulic, or pneumatic device. Preferably, however, positioning means 68 includes a reversible electric motor that is selectively connected to a source of electrical energy to move valve 36.

As discussed previously, when refrigeration machines of the general type described above are called on to simultaneously handle a low cooling load and a high heating load, the pressure at the inlet of the heating circuit, or booster, compressor may become very low. When this occurs, the temperature of the vapor discharged from the booster compressor may become undesirably high or the booster compressor may enter surge conditions. In light of the above, machine 10 includes means for preventing the vapor flow rate through second stage 26 of compressor 18 from increasing when the pressure in high pressure side 54 of cooling circuit 12 falls below a first predetermined value, and means for reducing the vapor flow rate through second stage 26 when the pressure in the high pressure side of the cooling circuit falls below a second predetermined value less than the first predetermined value.

More specifically, the above-mentioned preventing means includes pressure sensor 38 and positioning means 68. Positioning means 68 is connected to sensor 38 and, as mentioned above, to valve 36. When the pressure in primary condenser 20 falls below the first predetermined level, or set point, sensed by sensor 38, positioning means 68 is prevented from moving valve 36 toward its maximum position. This tends to prevent the rate at which vapor is drawn from primary condenser 20 by heating circuit 14 from increasing due to, for example, an increase in the load on heating circuit 14. This, in turn, tends to prevent the pressure in the primary condenser from decreasing. Should the pressure in primary condenser 20 rise back above the first predetermined level, sensor 38 no longer prevents positioning means 68 from moving valve 36 toward its maximum flow position; and the valve may be so moved, for example because of an increase in the heating load on circuit 14.

In contrast, should the pressure in primary condenser 20 continue to fall, for example, because of a further reduction in the cooling load on cooling circuit 12, sensor 38 also senses if the pressure in the primary condenser falls below the second predetermined level or set point. When this event is sensed, positioning means 68 is activated for moving valve 36 toward its minimum flow position to decrease the vapor flow rate through second stage 26 of compressor 18. Preferably, positioning means 68 continues to close valve 36 if the pressure in primary condenser 20 remains below the second set point, further reducing the vapor flow rate through heating circuit 14. With this arrangement, the rate at which vapor is drawn from primary condenser 20 by heating circuit 14 is reduced until that vapor flow rate matches or becomes less than the rate at which vapor enters the primary condenser via primary compressor 16. This tends to maintain the mass of refrigerant in primary condenser 20 at or above a stable value. In this manner, the pressure in primary condenser 20 may be maintained at or above a level sufficient to prevent second stage 26 of compressor 18 from entering surge conditions or from discharging vapor at an excessively high temperature. In case the pressure in primary condenser 20 rises back above the second set point, sensor 38 ceases to cause positioning means 68 to move valve 36 toward its minimum flow position. However, as may be understood from the above discussion, sensor 38 still prevents positioning means 68 from moving valve 36 toward its maximum flow position as long as the pressure in condenser 20 is below the first set point.

As will be apparent to one skilled in the art, pressure sensor 38 may be of any suitable type such as an electric, hydraulic, or pneumatic device. Since positioning means 68 preferably includes a reversible electric motor, pressure sensing means 38 preferably includes first and second pressure switches 40 and 42. Switch 40 senses when the pressure in primary condenser 20 falls below the first set point to disconnect the electric motor from the source of electrical energy to disable the motor from opening valve 36, while switch 42 senses when the pressure in primary condenser 20 falls below the second set point to connect the electric motor to the electrical energy source for closing valve 36. As shown in the drawing, switches 40 and 42 are disposed in chamber 70 which is in vapor communication with primary condenser 20 via tap-off line 72.

Refrigeration machine 10 incorporating teachings of the present invention may be effectively employed to prevent the booster compressor from entering surge conditions or from discharging vapor at undesirably high temperatures when the machine is called upon to simultaneously satisfy a low cooling load and a high heating load; and, as may be understood from a review of the above discussion, these beneficial results may be achieved in a very reliable and inexpensive manner. Moreover, the use of pressure sensor 38 which senses two pressure levels with a range between these levels, permits valve 36 to remain steady while the pressure is primary condenser 20 is within this range, reducing operational wear on the elements of valve 36 and increasing the reliability and working life thereof.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

We claim:

1. Apparatus for satisfying heating and cooling demands comprising:

a cooling circuit for satisfying the cooling demand and including a mechanical refrigeration unit having a high pressure side and a low pressure side;

a heating circuit for satisfying the heating demand and including a booster compressor for compressing refrigerant vapor, a booster inlet line for transmitting refrigerant vapor from the high pressure side of the refrigeration unit to the booster compressor for further compression therein, a heat reclaiming condenser for passing refrigerant vapor from the booster compressor in heat transfer relation with a heat transfer fluid to heat the fluid and condense the refrigerant vapor, and return means for returning condensed refrigerant from the heat reclaiming condenser to the refrigeration unit;

valve means for regulating the flow of vapor through the booster compressor; and valve control means including stabilizing means acting in response to the pressure in the high pressure side of the refrigeration unit falling below a first set point for preventing the valve means from increasing the vapor flow through the booster compressor, and means for operating the valve means to reduce the vapor flow rate through the booster compressor when the pressure in the high pressure side of the refrigeration unit falls below a second set point less than the first set point.

2. The apparatus as defined by claim 1 wherein the valve control means includes:

a sensor for sensing the pressure of vapor in the high pressure side of the refrigeration unit; and positioning means connected to the valve and the sensor for positioning the valve in response to the pressure of vapor in the high pressure side of the refrigeration unit.

3. The apparatus as defined by claim 2 wherein the pressure sensor includes:

a first pressure switch for preventing the positioning means from opening the valve when the pressure in the high side of the refrigeration unit falls below the first set point; and a second pressure switch for operating the positioning means to move the valve to decrease the vapor flow rate through the booster compressor when the pressure in the high pressure side of the refrigeration unit falls below the second set point.

4. The apparatus as defined by claim 3 wherein the booster inlet line is connected to a condenser of the refrigeration unit for receiving refrigerant vapor therefrom.

5. A control for a booster type refrigeration machine having a refigeration unit for satisfying a cooling demand and a heating circuit for satisfying a heating demand, the refrigeration unit having a high pressure side and a low pressure side, the heating circuit having a booster compressor for drawing and further compressing vapor from the high pressure side of the refrigeration unit, the control comprising:

valve means for regulating the flow of vapor through the booster compressor; and valve control means including means for stabilizing the valve means to prevent the vapor flow rate through the booster compressor from increasing when the pressure in the high pressure side of the refrigeration unit falls below a first set point, and means for operating the valve means to reduce the vapor flow rate through the booster compressor when the pressure in the high pressure side of the refrigeration unit falls below a second set point less than the first set point.

6. The control as defined by claim 5 wherein the valve control means includes:

positioning means for varying the valve means between minimum and maximum flow positions;

a first pressure switch for preventing the positioning means from moving the valve means toward the maximum flow position when the pressure in the high pressure side of the refrigeration unit falls below the first set point; and a second pressure switch for operating the positioning means to move the valve toward the minimum flow position to decrease the vapor flow rate through the booster compressor when the pressure in the high pressure side of the refrigeration unit falls below the second set point.

7. The invention as defined by claims 3 or 6 wherein;

the valve includes a modulating valve;

the positioning means includes a reversible electric motor for modulating the valve between minimum and maximum flow positions;

the first pressure switch disconnects the electric motor from a source of electrical energy when the pressure in a condenser of the refrigeration unit falls below the first set point for disabling the motor from moving the valve; and the second pressure switch connects the electric motor to the electrical energy source when the pressure in the condenser of the refrigeration unit falls below the second set point to move the valve toward the minimum flow position.

8. A method of controlling a booster type refrigeration machine used to simultaneously satisfy a cooling load and a heating load, the method comprising the steps of:

compressing refrigerant vapor and discharging the compressed refrigerant to a high pressure side of a refrigeration circuit;

further compressing a first portion of the compressed refrigerant;

condensing a second portion of the compressed refrigerant;

stabilizing the quantity of refrigerant further compressed when the pressure in the high pressure side of the refrigeration circuit falls below a first predetermined value; and reducing the quantity of refrigerant further compressed when the pressure of refrigerant in the high pressure side of the refrigeration circuit falls below a second predetermined value less than the first predetermined value.

9. The method as defined by claim 8 wherein:

the further compressing step includes the steps of passing refrigerant vapor from the high pressure side of the refrigeration circuit through a heating circuit, and compressing refrigerant vapor passing through the heating circuit;

the stabilizing step includes the steps of sensing the pressure in the high pressure side of the refrigeration circuit, and stabilizing the flow of refrigerant through the heating circuit when the sensed pressure falls below the first predetermined value; and the reducing step includes the step of decreasing the flow of refrigerant through the heating circuit when the sensed pressure falls below the second predetermined value.

* * * * *